US007823627B2

(12) United States Patent
Yeganeh et al.

(10) Patent No.: US 7,823,627 B2
(45) Date of Patent: Nov. 2, 2010

(54) DEVICE FOR GENERATING ACOUSTIC AND/OR VIBRATION ENERGY FOR HEAT EXCHANGER TUBES

(75) Inventors: Mohsen S. Yeganeh, Hillsborough, NJ (US); Glen B. Brons, Phillipsburg, NJ (US); Henry Alan Wolf, Morristown, NJ (US); Limin Song, West Windsor, NJ (US)

(73) Assignee: ExxonMobil Research & Engineering Company, Annandale, NJ (US)

( * ) Notice: Subject to any disclaimer, the term of this patent is extended or adjusted under 35 U.S.C. 154(b) by 1202 days.

(21) Appl. No.: 11/436,602

(22) Filed: May 19, 2006

(65) Prior Publication Data

US 2007/0267175 A1 Nov. 22, 2007

(51) Int. Cl.
*F28G 1/12* (2006.01)
*F28D 11/06* (2006.01)

(52) U.S. Cl. ..... 165/95; 165/84; 15/104.07; 96/33

(58) Field of Classification Search ..... 165/95, 165/303, 157, 158, 173; 96/32, 33, 34, 35, 96/356, 36, 37, 38; 15/104.03, 104.05, 104.07
See application file for complete search history.

(56) References Cited

U.S. PATENT DOCUMENTS

| | | | | | |
|---|---|---|---|---|---|
| 2,722,992 | A | * | 11/1955 | Roberts et al. | 96/33 |
| 2,922,085 | A | * | 1/1960 | Drenning et al. | 96/25 |
| 3,183,967 | A | | 5/1965 | Mettenleiter et al. | |
| 3,570,217 | A | * | 3/1971 | Steuernagel | 96/35 |
| 3,605,915 | A | * | 9/1971 | Gately et al. | 173/200 |
| 3,606,733 | A | * | 9/1971 | Arstikaitis | 96/18 |
| 3,835,817 | A | * | 9/1974 | Tuomaala | 122/379 |
| 3,920,085 | A | * | 11/1975 | Bourke | 96/34 |
| 4,421,067 | A | * | 12/1983 | Krowech | 122/390 |
| 4,741,292 | A | | 5/1988 | Novak | |
| 4,993,098 | A | | 2/1991 | Kharitonov et al. | |
| 5,238,055 | A | | 8/1993 | Kelley | |
| 5,282,891 | A | * | 2/1994 | Durham | 96/75 |
| 5,315,966 | A | | 5/1994 | Gamache et al. | |
| 5,540,275 | A | | 7/1996 | Eisinger | |

(Continued)

FOREIGN PATENT DOCUMENTS

| | | | |
|---|---|---|---|
| EP | 0 716 282 | A | 6/1996 |

(Continued)

OTHER PUBLICATIONS

International Search Report, PCT/US2007/011828, mailed Dec. 21, 2007.

(Continued)

*Primary Examiner*—Tho v Duong
(74) *Attorney, Agent, or Firm*—Glenn T. Barrett

(57) ABSTRACT

A device is coupled to a heat exchanger for mitigating fouling by applying a mechanical force to a fixed heat exchanger to excite a vibration in the heat exchange surface and produce shear waves in the fluid adjacent the heat exchange surface while the heat exchanger is in operation. An electromagnetic driven impulse device induces vibration onto heat exchanger tubes and/or an acoustic wave through the liquid service fluid to reduce fouling. The device can be mounted directly onto the outer part or piping and produces acoustical/vibrational modes onto the tube or near the surface of tubes.

25 Claims, 5 Drawing Sheets

U.S. PATENT DOCUMENTS

| | | | |
|---|---|---|---|
| 5,873,408 | A | 2/1999 | Bellet et al. |
| 6,460,628 | B1 | 10/2002 | Day et al. |

FOREIGN PATENT DOCUMENTS

| | | | |
|---|---|---|---|
| GB | 435 870 | A | 9/1936 |
| GB | 1 099 742 | A | 1/1968 |
| GB | 2 147 078 | A | 5/1985 |
| GB | 2 152 204 | A | 7/1985 |

OTHER PUBLICATIONS

Written Opinion, PCT/US2007/011828, mailed Dec. 21, 2007.
Singapore Patent Office Written Opinion, dated Nov. 27, 2009, 9 pgs.
Singapore Patent Office Search Report, dated Nov. 27, 2009, 7 pgs.

* cited by examiner

DEVICE FOR GENERATING ACOUSTIC AND/OR VIBRATION ENERGY FOR HEAT EXCHANGER TUBES

BACKGROUND OF THE INVENTION

1. Field of the Invention

This invention relates to heat exchangers used in refineries and petrochemical plants. In particular, this invention relates to mitigation of fouling in heat exchangers.

2. Discussion of Related Art

Fouling is generally defined as the accumulation of unwanted materials on the surfaces of processing equipment. In petroleum processing, fouling is the accumulation of unwanted hydrocarbons-based deposits on heat exchanger surfaces. It has been recognized as a nearly universal problem in design and operation of refining and petrochemical processing systems, and affects the operation of equipment in two ways. First, the fouling layer has a low thermal conductivity. This increases the resistance to heat transfer and reduces the effectiveness of the heat exchangers—thus increasing temperature in the system. Second, as deposition occurs, the cross-sectional area is reduced, which causes an increase in pressure drop across the apparatus and creates inefficient pressure and flow in the heat exchanger.

Heat exchanger in-tube fouling costs petroleum refineries hundreds of millions of dollars each year due to lost efficiencies, throughput, and additional energy consumption. With the increased cost of energy, heat exchanger fouling has a greater impact on process profitability. Petroleum refineries and petrochemical plants also suffer high operating costs due to cleaning required as a result of fouling that occurs during thermal processing of whole crude oils, blends and fractions in heat transfer equipment. While many types of refinery equipment are affected by fouling, cost estimates have shown that the majority of profit losses occur due to the fouling of whole crude oils and blends in pre-heat train exchangers.

Fouling in heat exchangers associated with petroleum type streams can result from a number of mechanisms including chemical reactions, corrosion, deposit of insoluble materials, and deposit of materials made insoluble by the temperature difference between the fluid and heat exchange wall.

One of the more common root causes of rapid fouling, in particular, is the formation of coke that occurs when crude oil asphaltenes are overexposed to heater tube surface temperatures. The liquids on the other side of the exchanger are much hotter than the whole crude oils and result in relatively high surface or skin temperatures. The asphaltenes can precipitate from the oil and adhere to these hot surfaces. Prolonged exposure to such surface temperatures, especially in the late-train exchanger, allows for the thermal degradation of the asphaltenes to coke. The coke then acts as an insulator and is responsible for heat transfer efficiency losses in the heat exchanger by preventing the surface from heating the oil passing through the unit. To return the refinery to more profitable levels, the fouled heat exchangers need to be cleaned, which typically requires removal from service, as discussed below.

Heat exchanger fouling forces refineries to frequently employ costly shutdowns for the cleaning process. Currently, most refineries practice off-line cleaning of heat exchanger tube bundles by bringing the heat exchanger out of service to perform chemical or mechanical cleaning. The cleaning can be based on scheduled time or usage or on actual monitored fouling conditions. Such conditions can be determined by evaluating the loss of heat exchange efficiency. However, off-line cleaning interrupts service. This can be particularly burdensome for small refineries because there will be periods of non-production.

Mitigating or possibly eliminating fouling of heat exchangers can result in huge cost savings in energy reduction alone. Reduction in fouling leads to energy savings, higher capacity, reduction in maintenance, lower cleaning expenses, and an improvement in overall availability of the equipment.

Attempts have been made to use vibrational forces to reduce fouling. U.S. Pat. No. 3,183,967 to Mettenleiter discloses a heat exchanger, having a plurality of heating tubes, which is resiliently or flexibly mounted and vibrated to repel solids accumulating on the heat exchanger surfaces to prevent the solids from settling and forming a scale. This assembly requires a specialized resilient mounting assembly however and could not be easily adapted to an existing heat exchanger. U.S. Pat. No. 5,873,408 to Bellet et al. also uses vibration by directly linking a mechanical vibrator to a duct in a heat exchanger. Again, this system requires a specialized mounting assembly for the individual ducts in a heat exchanger that would not be suitable for an existing system.

Thus, there is a need to develop methods for reducing in-tube fouling, particularly for use with existing equipment. There is a need to mitigate or eliminate fouling while the heat exchanger equipment is on-line. There is also a particular need to address fouling in pre-heat train exchangers in a refinery.

BRIEF SUMMARY OF THE INVENTION

Aspects of embodiments of the invention relate to providing a device for generating vibrational energy that produces shear waves in fluid adjacent a heat exchange surface to mitigate fouling of the surface.

Another aspect of embodiments of the invention relates to providing a device that can be added and used in an existing heat exchanger while in operation.

An additional aspect of embodiments of the invention relates to providing a device that can be controlled to impart an optimal amount of vibrational energy while maintaining the structural integrity of a system.

This invention is directed to a device for generating energy to induce vibration into a heat exchange system to mitigate fouling, comprising a base including an impact surface, the base being mounted to a heat exchanger, a spring loaded support mounted to the base, an impactor mounted on the spring loaded support, an actuator positioned adjacent to the impactor that selectively actuates the impactor to move with respect to the impact surface, wherein the impactor generates vibrational energy over a range of frequencies that is transferred through the base to the heat exchanger.

In a preferred embodiment the impactor is a steel ball, the spring loaded support is a resilient rod, and the actuator is an electromagnet.

A controller is connected to the actuator that controls the impactor to move based on a predetermined pattern to generate vibrations at a certain frequency. A sensor is coupled to the heat exchanger and connected to the controller to provide feedback relating to the vibrations induced by the impactor.

The device can be provided in combination with a heat exchanger, wherein the base is structurally connected to heat exchanger. The heat exchanger preferably includes a plurality of tubes that carry fluid for heat exchange. The vibrational energy generated from the impactor is imparted to the fluid carried by the tubes. The heat exchanger can be in situ in a refinery.

The invention is also directed to a kit for retrofitting a heat exchanger in a refinery with a fouling mitigation system, where the heat exchanger has a heat exchange surface exposed to fluid flow. The kit comprises a device for generating energy to induce vibration in the heat exchanger. The device includes a base with an impact surface, a spring loaded support mounted to the base, an impactor mounted on the spring loaded support, and an actuator positioned adjacent to the impactor that selectively actuates the impactor to strike the impact surface. A mounting device forms a structural connection between the device for generating energy and the heat exchanger. A controller is connected to the actuator that selectively drives the actuator in accordance with a predetermined frequency to generate vibrational energy over a range of frequencies that is transferred through the base to the heat exchanger for producing shear waves in the fluid flow.

These and other aspects of the invention will become apparent when taken in conjunction with the detailed description and appended drawings.

BRIEF DESCRIPTION OF THE DRAWINGS

The invention will now be described in conjunction with the accompanying drawings in which.

In the drawings, like reference numerals indicate corresponding parts in the different figures.

DETAILED DESCRIPTION OF PREFERRED EMBODIMENTS

This invention is directed to a device for mitigating fouling in heat exchangers, in general. In a preferred use, the device is applied to heat exchangers used in refining processes, such as in refineries or petrochemical processing plants. Such processing generally involves whole crude oils, blends and fractions, which will be referred to collectively herein merely as crude oils for purposes of simplicity. The invention is particularly suited for retrofitting existing plants so that the process may be used in existing heat exchangers, especially while the heat exchanger is on line and in use. Of course, it is possible to apply the invention to other processing facilities and heat exchangers, particularly those that are susceptible to fouling in a similar manner as experienced during refining processes and are inconvenient to take off line for repair and cleaning.

While this invention can be used in existing systems, it is also possible to initially manufacture a heat exchanger with the vibration inducing device described herein in new installations.

Heat exchange with crude oil involves two important fouling mechanisms: chemical reaction and the deposition of insoluble materials. In both instances, the reduction of the viscous sub-layer (or boundary layer) close to the wall can mitigate the fouling rate. This concept is applied in the process according to this invention.

In the case of chemical reaction, the high temperature at the surface of the heat transfer wall activates the molecules to form precursors for the fouling residue. If these precursors are not swept out of the relatively stagnant wall region, they will associate together and deposit on the wall. A reduction of the boundary layer will reduce the thickness of the stagnant region and hence reduce the amount of precursors available to form a fouling residue. So, one way to prevent adherence is to disrupt the film layer at the surface to reduce the exposure time at the high surface temperature. In accordance with this invention, the process includes vibrating the wall to cause a disruption in the film layer.

In the case of the deposition of insoluble materials, a reduction in the boundary layer will increase the shear near the wall. By this, a greater force is exerted on the insoluble particles near the wall to overcome the particles' attractive forces to the wall. In accordance with the invention, vibration of the wall in a direction perpendicular to the radius of the tube will produce shear waves that propagate from the wall into the fluid. This will reduce the probability of deposition and incorporation into the fouling residue.

Figure 9:
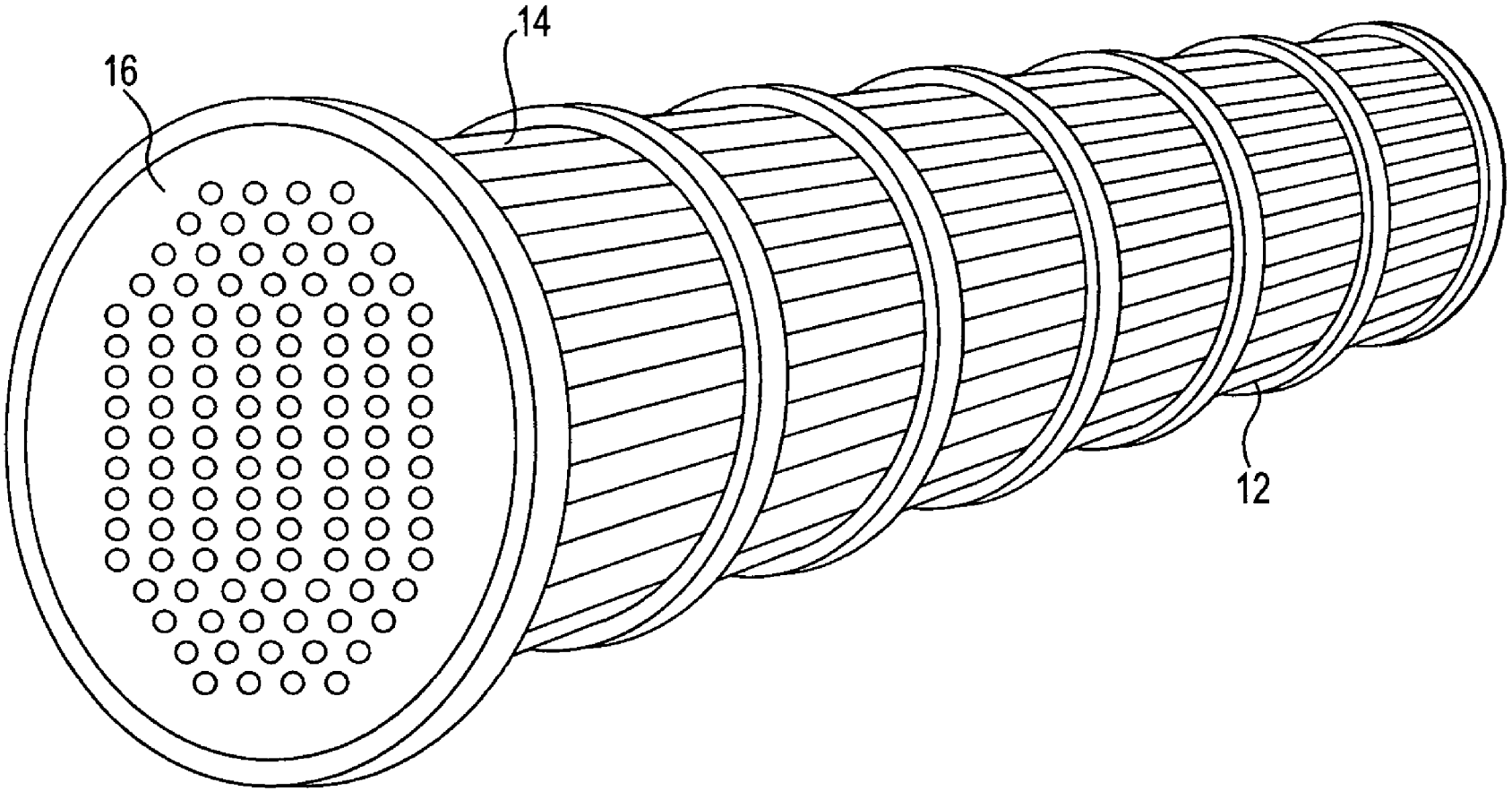
FIG. 9 is a side perspective view of a shell-tube heat exchanger.

Referring to the drawings, FIG. 9 shows a conventional shell-tube type heat exchanger in which a bundle 12 of individual tubes 14 are supported by at least one tube sheet flange 16. The bundle 12 is retained within a shell 18, seen in FIG. 10, that has an inlet and outlet (not shown) so that one fluid flows inside of the tubes while another fluid is forced through the shell and over the outside of the tubes to effect a heat exchange, as is known. As described above in the background section, the wall surfaces of the tubes, including both inside and outside surfaces, are susceptible to fouling or the accumulation of unwanted hydrocarbon based deposits.

It will be recognized by those of ordinary skill in the heat exchanger art that while a shell-tube exchanger is described herein as an exemplary embodiment, the invention can be applied to any heat exchanger surface in various types of known heat exchanger devices. Accordingly, the invention should not be limited to shell-type exchangers.

Figure 10:
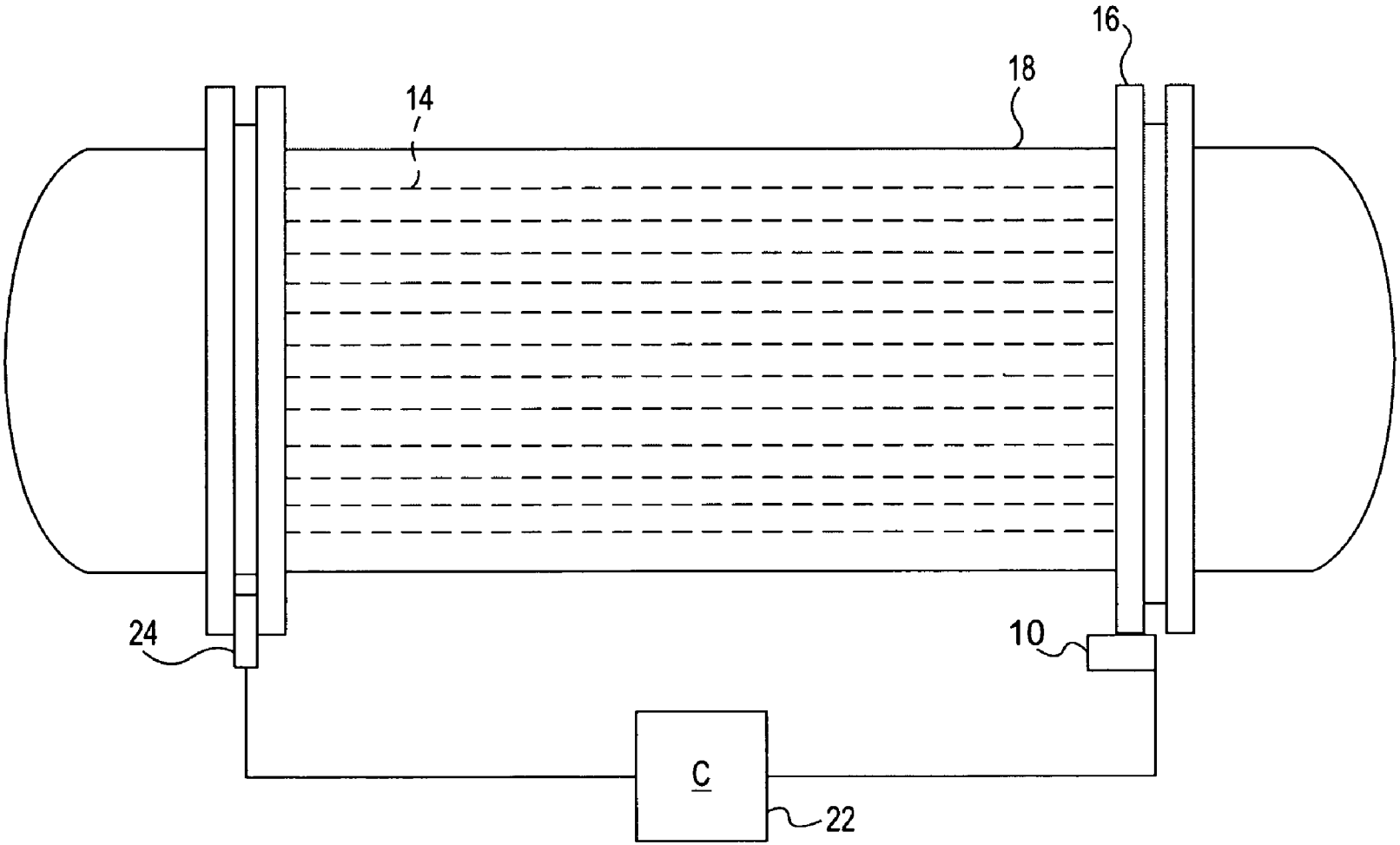
FIG. 10 is a side view of a shell-tube heat exchanger with a mechanically induced vibration system in accordance with this invention.

FIG. 10 shows a preferred embodiment of the invention in which a dynamic actuator device 10, in accordance with the invention, is added to the heat exchanger. The dynamic actuator device 10 is a device for generating energy to induce vibration into a heat exchange system. In this case, the dynamic actuator device 10 is positioned at the flange 16 of the exchanger to impart controlled vibrational energy to the tubes 14 of the bundle 12. A mounting device couples the dynamic actuator device 10 to the flange 16. Any suitable mounting device can be used to provide a mechanical link between the dynamic actuator device 10 and the heat exchanger. It can be designed as a heat insulator to shield the dynamic actuator device 10 from excessive heat. It could also be formed as a seismic mass. The mounting device could also function as a mechanical amplifier for the dynamic actuator device 10 if necessary.

A controller 22 is preferably in communication with the dynamic actuator device 10 to control the forces applied to the heat exchanger. A sensor 24 coupled to the heat exchanger can be provided in communication with the controller 22 to provide feedback for measuring vibration and providing data to the controller 22 to adjust the frequency and amplitude output of the dynamic actuator device 10 to achieve shear waves in the fluid adjacent the tubes to mitigate fouling while minimizing any negative effect of the applied force on the structure integrity.

The controller 22 can be any known type of processor, including an electrical microprocessor, disposed at the location or remotely, to generate a signal to drive the dynamic actuator device 10 with any necessary amplification. The controller 22 can include a signal generator, signal filters and amplifiers, and digital signal processing units.

The dynamic actuator device 10 is designed to induce tube vibration while maintaining structural integrity of the heat exchanger. If desired, an array of dynamic actuators 10 can be spatially distributed to generate the desired dynamic signal to achieve an optimal vibrational frequency.

Figure 1:
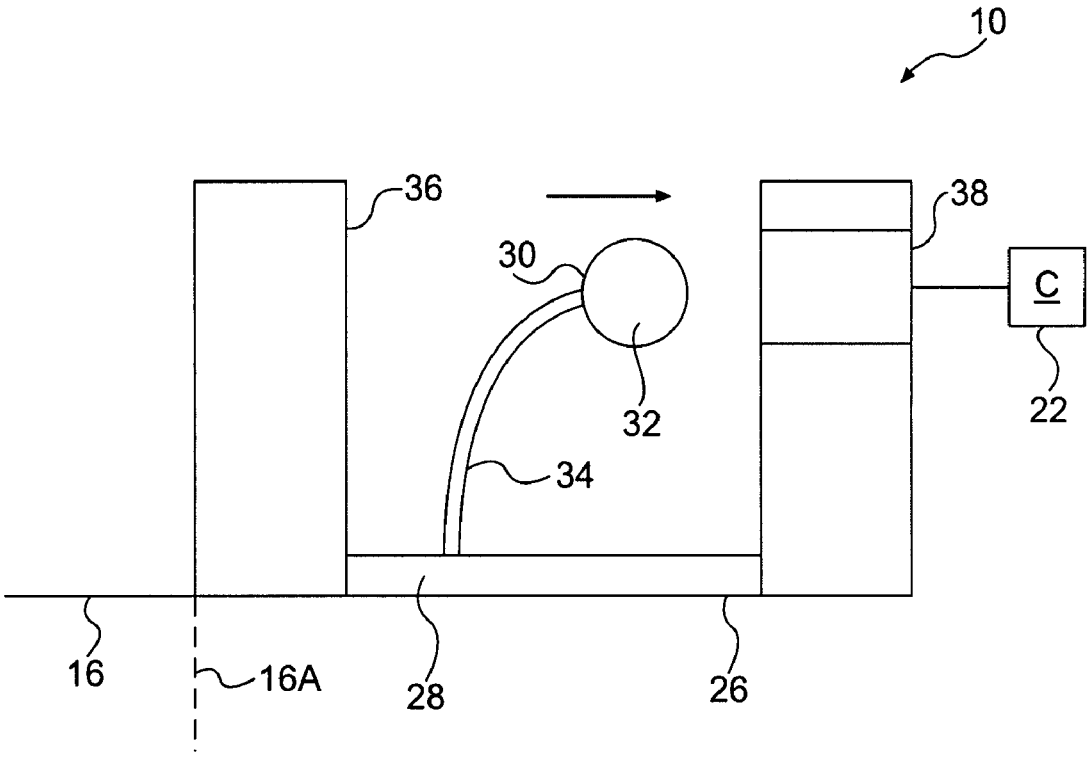
FIG. 1 is a side view of the device for generating vibrational energy in a first position in accordance with this invention.
Figure 2:
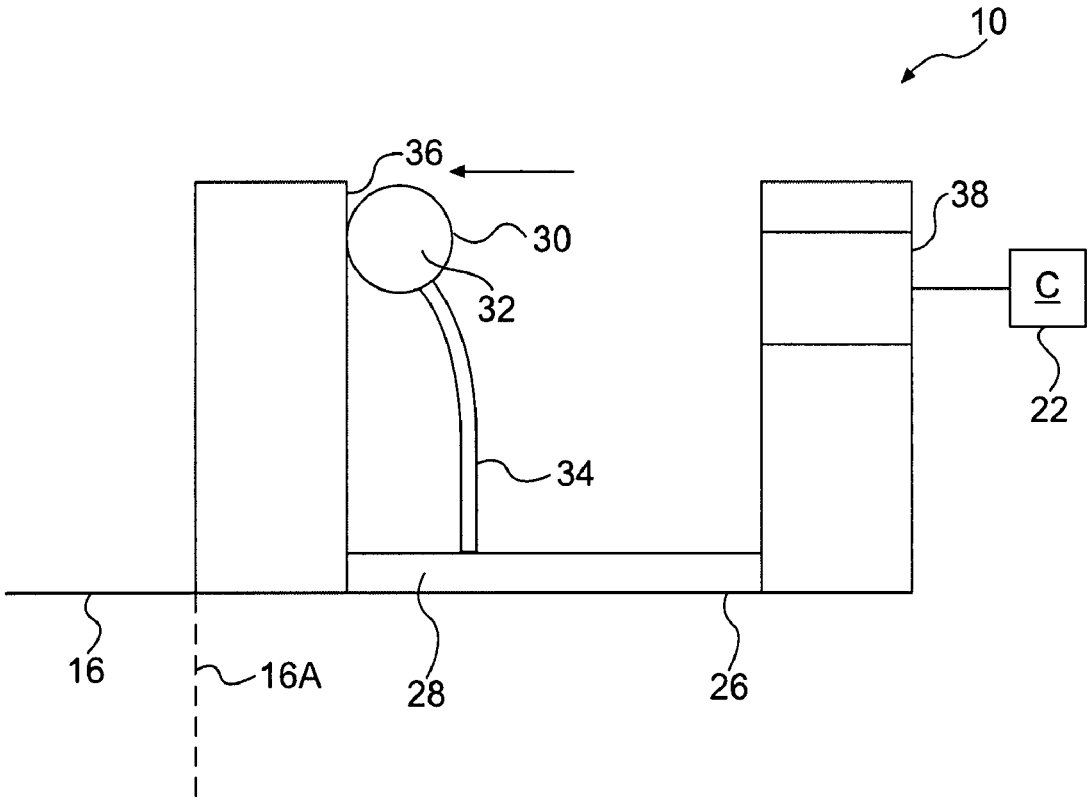
FIG. 2 is a side view of the device of FIG. 1 in a second position.

FIGS. 1 and 2 show the details of the dynamic actuator device 10 in accordance with a preferred embodiment of this invention. The dynamic actuator device 10 includes a base 26 that has a support 28 and an impactor 30 that is mounted to the support 28. The impactor 30 in this embodiment is a ball 32 carried on a spring loaded rod 34. The ball 32 can be any hard material, such as steel, and the spring loaded rod 34 can be any strong resilient or flexible material, such as metal or plastic, that will support the ball 32 in an upright manner, yet allow the ball to move between positions, as described below.

The base 26 also includes an impact surface 36 that is disposed adjacent to the impactor 30 and is made of any hard material, for example a steel block. The impact surface 36 can be a portion of the base 26 and integral with the support 28, it can be connected to the support 28, or it can be proximate to the base 26. It is important that the impact surface 36 be connected to structure that can directly transfer vibrations to the heat exchanger structure. To effectively transfer vibrations it is preferred that the structure is fixed in place. It is also possible to use an existing surface on the heat exchanger that can transfer vibrations to the tubes.

An actuator 38 is supported by the base 26 or can be disposed proximate to the base 26 adjacent to the impactor 30 so as to cause the impactor 30 to move with respect to the impact surface 36. The actuator 38 can be any mechanism that causes the impactor to move, especially to cause the ball 32 to move toward and away from the impact surface 36. In a preferred embodiment, the actuator 38 is an electromagnet that is driven by a controller 22, for example a controller with a pulse generator.

Preferably, the components of the dynamic actuator device 10 are formed as a unit, with the impactor 30, impact surface 36 and actuator 38 supported together to allow easy installation and efficient retrofit to an existing heat exchanger. By this, the device 10 can be simply attached to the desired system, such as a shell-tube heat exchanger, to impart vibrational energy to the system.

In operation, the actuator 38 retains the impactor 30 in a first position spaced from the impact surface 36, as seen in FIG. 1. The actuator 38 then selectively causes the impactor 30 to move toward the impact surface 36, thus striking the impact surface 36 and imparting vibration through the base 26 to the structural support of the heat exchanger. This is seen in FIG. 2 where the impactor 30 is in a second position.

In the preferred embodiment, the electromagnet 38 is charged and attracts the steel ball 32, as seen in FIG. 1. The spring loaded rod 34 is flexed and stores mechanical energy. The pulse generator of the controller 22 charges the electromagnet 38 in accordance with a predetermined frequency. On the off cycle of the electromagnet 38, the ball 32 is released and the stored mechanical energy in the rod 34 causes the ball 32 to swing toward and strike the impact surface 36, as seen in FIG. 2. The force of the strike induces a pulse into the block of the impact surface 36 that transfers to the base 26, through the flange 16 and ultimately to the tubes 14 of the heat exchanger.

Of course, any device capable of creating vibrational energy may be used. For example, instead of a ball, the impactor could be formed as a hammer. The rod could be replaced with another type of movable support, such as a lever, swing arm, plunger or rotating support. It is also possible to actuate movement of the impactor by other means than an electromagnet, such as a small motor. A suitable motor can be electrically or pneumatically driven and can use a gear system and/or cam arrangement to cause movement that creates vibrational energy.

The pulse from the impactor 30 induces a longitudinal mode of vibration in the system when the dynamic actuator device 10 is mounted with the base 26 axially oriented with respect to the heat exchanger as shown by the mounting arrangement on flange 16 in FIGS. 1 and 2. Alternatively, vibration may be induced in a transverse mode by mounting the base 26 perpendicular to the heat exchanger tubes as shown by the mounting arrangement on flange 16A in FIGS. 1 and 2. A combination of the above mounting arrangements can also be used.

The controller 22 will preferably be connected to the sensor 24 to monitor the induced vibrations and control the frequency of the impacts and resultant vibrations to optimize shear waves adjacent to the heat exchange surfaces, in this case the tubes 14, while maintaining structural integrity of the system, as explained below.

The dynamic actuator device 10 may be placed at various locations on or near the heat exchanger as long as there is a mechanical link to the tubes 14. The flange 16 provides a direct mechanical link to the tubes 14. The rim of the flange 16 is a suitable location for connecting the dynamic actuator device 10. Other support structures coupled to the flange 16 would also be mechanically linked to the tubes. For example, the header supporting the heat exchanger would also be a suitable location for the dynamic actuator device 10. Vibrations can be transferred through various structures in the system so the actuator does not need to be directly connected to the flange 16.

Figure 3:
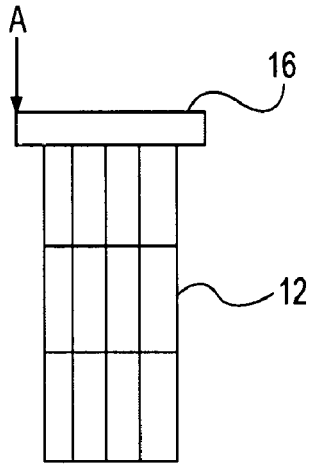
FIG. 3 is a side schematic view of a heat exchanger with the mechanically induced vibration system located at the tube-sheet flange and positioned axially with respect to the tube bundle.
Figure 4:
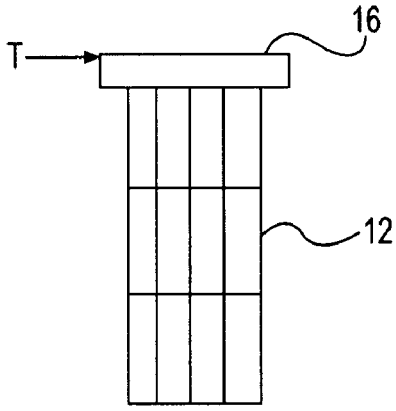
FIG. 4 is a side schematic view of a heat exchanger with the mechanically induced vibration system located at the tube-sheet flange and positioned transversely with respect to the tube bundle.
Figure 5:
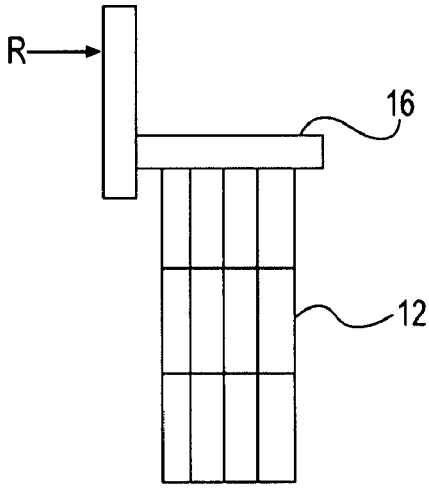
FIG. 5 is a side schematic view of a heat exchanger with the mechanically induced vibration system located remotely with respect to the tube-sheet flange.

As explained above and seen schematically in FIGS. 3-5, the force applied by the dynamic actuator device 10 can be oriented in various directions with respect to the tubes in accordance with this invention. FIG. 3 shows an axial force A applied directly to the flange 16 of the heat exchanger. FIG. 4 shows a transverse force T applied directly to the flange 16 of the heat exchanger. FIG. 5 shows a remote force R applied to a structural member connected to the flange 16 of the heat exchanger. All of the above applications of force would be suitable and would induce vibrations in the tubes 14. Depending on the system application, the force would be controlled to maintain the structural integrity of the heat exchanger, particularly the bundle 12. The force could be applied continuously or intermittently.

Figure 6:
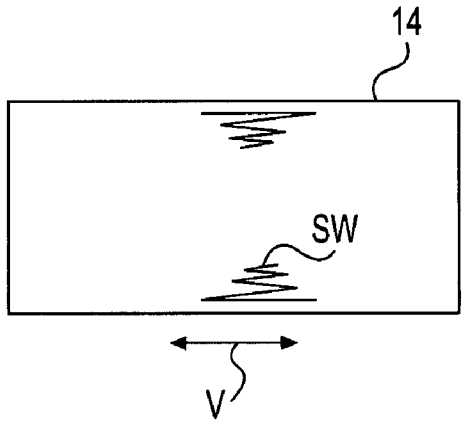
FIG. 6 is a schematic drawing of the inside of a tube showing axial wall vibration.
Figure 7:
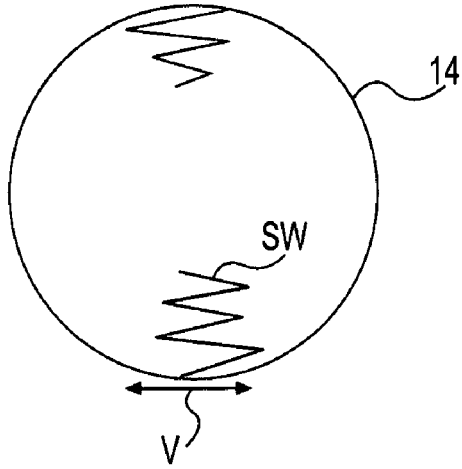
FIG. 7 is a schematic drawing of the inside of a tube showing tangential or torsional wall vibration.

In the above applications in accordance with this invention, the actuation of a dynamic force creates tube wall vibration V and corresponding shear waves SW in the fluid adjacent the walls, as seen in FIGS. 6 and 7. Certain tube vibration modes will induce oscillating shear waves of fluid near the tube wall, but the shear waves will dampen out very quickly from the wall into the fluid creating a very thin acoustic boundary layer and a very high dynamic shear stress near the wall. The dampened shear waves disrupt the relative quiescent fluid boundary layer in contact with the inside tube surface, thus preventing or reducing fouling precursors from settling down and subsequently growing and fouling.

Figure 8:
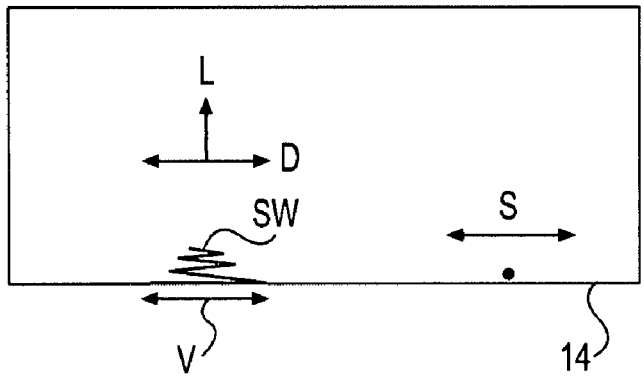
FIG. 8 is a schematic drawing showing lift, drag and shear forces inside a vibrating tube.

The inventors have determined through experimentation that mechanical vibration in accordance with this inventive concept will considerably reduce the extent of fouling. With proper vibration frequencies, the thickness of the oscillating fluid can be made sufficiently small so that the fluid within the sub-laminar boundary layer, otherwise stagnant without shear waves, will be forced to move relative to the wall surface. The concept is shown in FIG. 8. Shear waves SW near the wall exert both drag D and lifting L forces on the precursors or foulant particles in the fluid. The dynamic drag force D keeps the particles in motion relative to the wall, preventing them from contacting the wall and thus reducing the probability of the particles sticking to the wall, which is a necessary condition for fouling to take place. At the same time, the lifting force L causes the particles to move away from the wall surface and into the bulk fluid, thus reducing particle concentration near the wall and further minimizing the fouling tendency. For a particle already adhered to the wall, the shear waves also exert a shear force S on the particle, tearing it off from the wall if the shear force is strong enough. The inherent unsteadiness of the shear waves within the boundary layer makes them more effective in reducing fouling than the high velocity effect of bulk flow. The adherence strength of a particle to the tube wall in an oscillating flow would be expected to be much lower than in a steady unidirection flow. Thus, the cleaning effect of shear waves is highly effective.

Selection of the precise frequency will of course be dependent on the design of the heat exchanger and type of dynamic actuator employed. However, selection will be based on determining an optimum frequency that imparts enough energy to prevent buildup on the tube wall while avoiding damage to the heat exchanger parts. Ideally, the driving frequency will be different from the natural frequency of the heat exchanger part as matching the driving frequency to the resident mode of the device can create damage to the heat exchanger parts. An acceptable range of driving frequency would be about 200 Hz to about 5,000 Hz, more preferably about 500 Hz to 1,000 Hz, while avoiding the resonance frequency of the heat exchange structure.

It is advantageous to use high frequency vibration for fouling mitigation because (1) it creates a high wall shear stress level, (2) there is a high density of vibration modes for easy tuning of resonance conditions, (3) there is low displacement of tube vibration to maintain the structural integrity of the heat exchanger, and (4) there is a low offensive noise level.

Selection of the precise mounting location, direction, and number of the dynamic actuators 10 and control of the frequency of the amplitude of the actuator output is based on inducing enough tube vibration to cause sufficient shear motion of the fluid near the tube wall to reduce fouling, while keeping the displacement of the transverse tube vibration small to avoid potential tube damage. Obviously, the addition of a dynamic actuator device 10 can be accomplished by coupling the system to an existing heat exchanger, and actuation and control of the dynamic actuator can be practiced while the exchanger is in place and on line. Since the tubesheet flange is usually accessible, vibration actuators can be installed while the heat exchanger is in service. Fouling can be reduced without modifying the heat exchanger or changing the flow or thermal conditions of the bulk flow.

Various modifications can be made in the invention as described herein, and many different embodiments of the device and method can be made while remaining within the spirit and scope of the invention as defined in the claims without departing from such spirit and scope. It is intended that all matter contained in the accompanying specification shall be interpreted as illustrative only and not in a limiting sense.

What is claimed is:

1. A device for generating energy to induce vibration into a heat exchange system to mitigate fouling, comprising:

a base including an impact surface, the base being mounted to a heat exchanger;

a spring loaded support mounted to the base, wherein the spring loaded support is a resilient rod, wherein the resilient rod having a first end and a second end, wherein the first end is secured to the base;

an impactor mounted on the second end of the spring loaded support;

an actuator positioned adjacent to the impactor that selectively actuates the impactor to move with respect to the impact surface, wherein the impactor generates vibrational energy that is transferred through the base to the heat exchanger, wherein the spring loaded support having a first position whereby the impactor is held adjacent the impactor against the bias of the spring loaded support and a second position whereby the impactor contacts the impact surface to generate impactor induced vibrations into the heat exchange system.

2. The device of claim 1, wherein the impactor is a steel ball.

3. The device of claim 1, wherein the actuator is an electromagnet.

4. The device of claim 1, wherein the impactor is made of metal and the impact surface is made of metal.

5. The device of claim 1, further comprising a controller connected to the actuator that controls the impactor to move.

6. The device of claim 5, wherein the controller controls the actuator based on a predetermined pattern to generate vibrations at a certain frequency.

7. The device of claim 6, wherein the controller controls the actuator to generate vibrations at a frequency of between about 200 Hz to 5,000 Hz.

8. The device of claim 6, wherein the controller controls the actuator to generate vibrations at a frequency of between about 500 Hz and 1,000 Hz.

9. The device of claim 5, further comprising a sensor coupled to the heat exchanger and connected to the controller to provide feedback relating to the vibrations induced by the impactor.

10. The device of claim 1, further comprising a sensor coupled to the heat exchanger to provide feedback relating to the vibrations induced by the impactor.

11. The device of claim 1, in combination with a heat exchanger, wherein the base is structurally connected to heat exchanger.

12. The device of claim 11, wherein the heat exchanger includes a plurality of tubes that carry fluid for heat exchange and wherein the vibrational energy generated from the impactor is imparted to the fluid carried by the tubes.

13. The device of claim 12, wherein the base is connected so that the impactor generates a longitudinal mode of vibration in the tubes.

14. The device of claim 12, wherein the base is connected so that the impactor generates a transverse mode of vibration in the tubes.

15. The device of claim 12, wherein the base is connected so that the impactor generates longitudinal and transverse modes of vibration in the tubes.

16. The device of claim 11, in combination with a refinery.

17. A kit for retrofitting a heat exchanger in a refinery with a fouling mitigation system, the heat exchanger having a heat exchange surface exposed to fluid flow, the kit comprising:

a device for generating energy to induce vibration in the heat exchanger, including a base with an impact surface, a spring loaded support mounted to the base, wherein the spring loaded support is a resilient rod, wherein the resilient rod having a first end and a second end, wherein the first end is secured to the base, an impactor mounted on the second end of the spring loaded support, and an actuator positioned adjacent to the impactor that selectively actuates the impactor to strike the impact surface, wherein the spring loaded support having a first position whereby the impactor is held adjacent the impactor against the bias of the spring loaded support and a second position whereby the impactor contacts the impact surface to generate impactor induced vibrations into the heat exchange system;

a mounting device for forming a structural connection between the device for generating energy and the heat exchanger; and a controller connected to the actuator that selectively drives the actuator in accordance with a predetermined frequency to generate vibrational energy that is transferred through the base to the heat exchanger for producing shear waves in the fluid flow.

18. The kit of claim 17, wherein the impactor is a steel ball.

19. The kit of claim 17, wherein the actuator is an electromagnet.

20. The kit of claim 17, wherein the controller includes a pulse generator.

21. The kit of claim 17, wherein the controller controls the actuator based on a predetermined pattern to generate vibrations at a certain frequency.

22. The kit of claim 21, wherein the controller controls the actuator to generate vibrations at a frequency of between about 200 Hz and 5,000 Hz.

23. The kit of claim 21, wherein the controller controls the actuator to generate vibrations at a frequency of between about 500 Hz and 1,000 Hz.

24. The kit of claim 17, further comprising a sensor coupled to the heat exchanger and connected to the controller to provide feedback relating to the vibrations induced by the impactor.

25. The device of claim 1, in combination with a heat exchanger, wherein the generated frequencies range from 200-10,000 Hz.

* * * * *